United States Patent [19]

Bagwell

[11] 4,393,790

[45] Jul. 19, 1983

[54] SAFE DOOR ASSEMBLY

[76] Inventor: William H. Bagwell, 1610 Country Club Prado, Coral Gables, Fla. 33134

[21] Appl. No.: 272,323

[22] Filed: Jun. 10, 1981

[51] Int. Cl.[3] ..... E05G 1/04; E05B 63/00; E05B 63/14; E05B 15/16

[52] U.S. Cl. ..... 109/76; 109/64; 109/59 R; 70/1.5; 70/119; 70/422

[58] Field of Search ..... 109/59 R, 60–61, 109/63.5, 64, 76–77, 62.4; 70/1.5, 1.7, 118, 119, 113, 102, 103, 115, DIG. 58, 422; 411/1, 2, 3

[56] References Cited

U.S. PATENT DOCUMENTS

| | | | |
|---|---|---|---|
| 591,200 | 10/1897 | Stevenson | 70/1.5 |
| 876,028 | 1/1908 | Taylor | 70/422 |
| 928,904 | 7/1909 | Cottrell | 70/118 |
| 940,268 | 11/1909 | Norris | 109/76 |
| 1,916,406 | 7/1933 | Bell | 109/76 |
| 1,967,779 | 7/1934 | Paca | 109/76 |
| 3,063,282 | 11/1962 | Aytes | 70/119 |

FOREIGN PATENT DOCUMENTS

| | | | |
|---|---|---|---|
| 2057043 | 3/1981 | United Kingdom | 109/64 |

*Primary Examiner*—Robert Peshock
*Assistant Examiner*—John G. Weiss
*Attorney, Agent, or Firm*—Arthur G. Yeager

[57] ABSTRACT

A safe door assembly comprising a door casing, a door, a plurality of locking bolts operated by a combination lock so as to be selectively extended outwardly from or retracted inwardly into said door to lock or unlock, respectively, the door to the casing; the casing including a seat to accomodate a shoulder on a door and a recess to receive each of the outwardly extending locking bolts, the door having a combination lock with a retractable tongue directly connected to one locking bolt and also connected via a sliding link bar and lever means to the remaining locking bolts in such a fashion that all bolts extend and retract simultaneously; a pivotable relocking bar spring biased to pivot into a position which prevents movement of the sliding link bar and thereby prevents retraction of the locking bolts when the combination lock is displaced inwardly from its normal position; the assembly also comprising a hardened steel barrier protecting the outer extremities of said locking bolts from access by a drill, a hook means of attachment of one locking bolt to the tongue of the combination lock, and weakened handle support bolts which will shear in the shank portion when subjected to the normal torque or unloosening the bolt from its lock nut. The safe door assembly of this invention provides an improved protection against unauthorized tampering.

25 Claims, 5 Drawing Figures

SAFE DOOR ASSEMBLY

BACKGROUND OF THE INVENTION

The design and manufacture of safes have extended over many years in the past and have included many novel features. Improvements in the quality and versatility of hand tools have permitted thieves to break into safes that were considered to be tamperproof and accordingly improvements in safes have been necessary to stay beyond the capabilities of the thief.

Most safes, regardless of their size, include a combination lock encased in a heavy steel door and operating to extend or retract a plurality of sliding bolts from the door into matching recesses in the door casing to lock or unlock the door to the casing. Two frequently used methods for tampering with a safe have been to smash the combination lock mechanism by hammering on the dial and by selectively drilling through the door to destroy components of the locking mechanism. On extremely large safes, such as those found in banks, the door can be made thick enough to thwart any attempt at using a hand drill to pierce the door and the combination mechanism can be made sufficiently sturdy to withstand repeated hammering. Small safes, however, which are mounted in a wall or a floor of a room must be small enough to be opened and manipulated by a person and this limitation will not permit the use of extremely thick sections of doors and walls, nor will it permit the use of sturdy combination lock dials that can be employed in larger safes. Accordingly, it has been necessary to resort to other means for providing better protection against tampering by thieves. It is an object of this invention to provide those improvements.

BRIEF SUMMARY OF THE INVENTION

This invention provides an improvement in a safe door assembly comprising a door casing, a door, a plurality of locking bolts operated by a combination lock so as to be selectively extended outwardly from or retracted inwardly into said door to lock or unlock, respectively, said door to said casing; said casing including a seat to accomodate a shoulder of said door and a recess to receive each of said outwardly extending locking bolts; said door also including a combination lock with a retractable tongue operatively connected to a sliding link bar with lever means to simultaneously extend or retract locking bolts; the improvement comprising a pivotable relocking bar spring biased to pivot into a position whereby a portion of said bar mates with a corresponding portion in said link bar to prevent said link bar from sliding, said relocking bar positioned to mate with said link bar when said combination lock is displaced inwardly from its normal position. In one embodiment of this invention a hardened steel barrier is spaced apart from and placed around the outer end of the locking bolts to protect the ends of the locking bolts from access from outside the safe by a drill. In another embodiment of this invention the combination lock is equipped with a retractable tongue which moves outwardly and inwardly when the lock mechanism respectively locks or unlocks the safe door; one locking bolt being connected to said tongue by a hook connection on the bolt attaching to a transverse slot in the tongue; and a pin attachment to transmit movement of the tongue to corresponding movement of the sliding link bar which causes other locking bolts to move simultaneously therewith. In still another embodiment of this invention shoulder bolts which attach a hardened steel plate to the inside surface of the door are weakened in their shank portions to the extent that the normal torque for unloosening said bolts from their corresponding lock nuts will cause shearing of the heads of bolts while leaving shoulder in a counter bore in the door to maintain the attachment of the hardened steel plate.

BRIEF DESCRIPTION OF THE DRAWINGS

The novel features believed to be characteristic of the invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
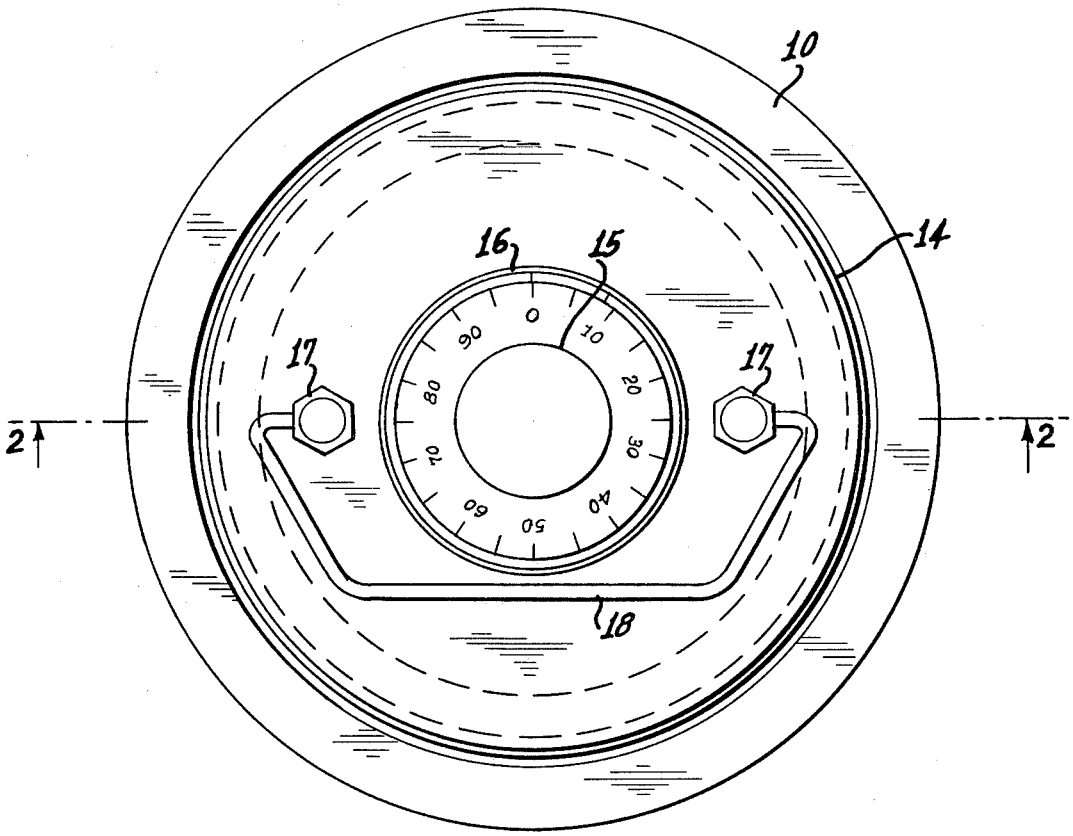
FIG. 1 is a top plan view of one embodiment of the safe door assembly of this invention.

The improvements of this invention are applicable to any safe door regardless of its size, but as explained above, they find their greatest usefulness in small safes which may be mounted in the wall or the floor of a room, or which may be a separate enclosure placed wherever desired in a room. In the drawings which accompany this description the safe is shown as one which might be mounted in the floor of a room, the door being lifted out of the door casing when the mechanism is in the unlocked position. In this instance there are no hinges to support the door but it can be readily appreciated that the assembly of this invention is adaptable to such an arrangement.

Figure 2:
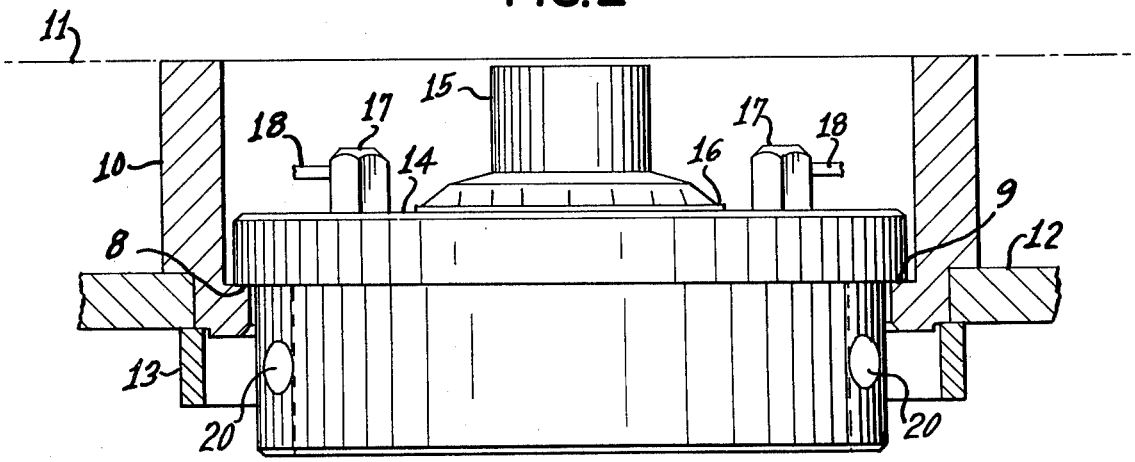
FIG. 2 is a cross sectional view taken along line 2—2 of FIG. 1.
Figure 3:
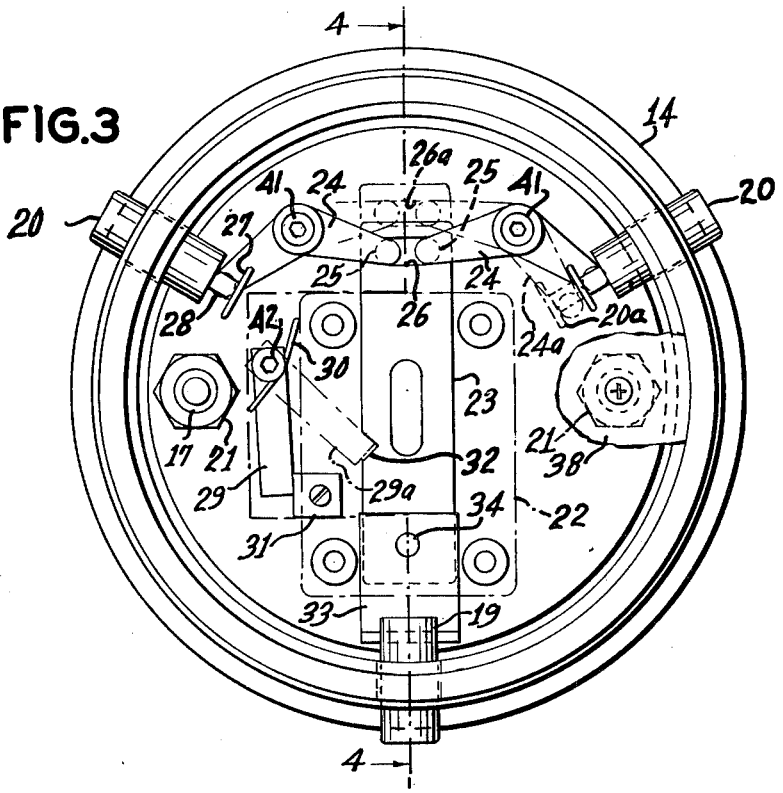
FIG. 3 is a bottom plan view of the safe door assembly of FIG. 1.

In FIGS. 1, 2, and 3 the principal features of the safe door assembly of this invention can be seen. The safe is mounted below floor line 11 with the details of mounting the safe not being illustrated. Door casing 10 is mounted in safe wall 12 with the upper edge of door casing 10 being mounted flush with floor line 11. Door casing 10 is generally cylindrical in shape and has a seat 9 in the form of an inwardly extending flange which serves to support shoulder 8 of safe door 14. The lower extremity of door casing 10 serves as a recess to receive the outward extension of locking bolts 20 when door 14 is to be locked into place. The movement outwardly or inwardly of locking bolts 20 is governed by an appropriate setting of the combination lock dial 15 with respect to index marks on ring 16. When dial 15 has been turned through the necessary routine of successive numbers as required by the combination lock mechanism, dial 15 can be turned to cause movement of locking bolts 20 from the outwardly extended position (locked) to their inwardly retracted position (unlocked). Door 14 can then be opened by lifting it out of the opening of door casing 10. For this purpose handle 18 is provided and supported by shoulder bolts 17.

One frequent method of tampering with a locked safe is to employ a drill which can reach the outer extremities of the locking bolts 20 and cut away enough of the locking bolts 20 to permit the safe door 14 to be opened without regard to the setting of the combination lock mechanism. It is a feature of this invention to provide a hardened steel ring 13 welded, or otherwise attached, to the bottom casing 10 and functioning as a protection against attack by a drill to the outside extremities of locking bolts 20. It is well known that steel can be hardened by appropriate heat treatment and be made substantially imprevious to a hand drill. The exact design and placement of hardened steel ring 13 can very with the design of the safe door assembly. It is not necessary that there be a complete ring around the door since it is only necessary to protect the ends of locking bolt 20. In the instance shown in this drawing there are three locking bolts and three separate barriers can be employed to provide the protection intended in this invention. Similarly, if the door is rectangular in shape rather than circular hardened steel barrier 13 may not be a ring but rather can be a strip or sheet to serve this purpose. It is to be understood, however, that any of these obvious modifications are within the scope of this invention whenever the barrier is placed around the outer extremities of the locking bolt 20 to protect them from unauthorized attempts to enter the safe. Since barrier 13 must not interfere with the normal operation of opening and closing the safe door 14, barrier 13 must be spaced apart from the ends of locking bolts 20 in their most outwardly extended position.

In FIG. 3 there is illustrated the actuating mechanism for locking and unlocking door 14. Combination lock mechanism 22 is shown merely as a retangular housing with the details of the lock mechanism not illustrated since this is a component that can be obtained commercially. The mechanism is operated by rotating dial 15 to match an index to a particular series of numbers, and when that series has been accomplished, dial 15 can be moved to the right or to the left, respectively to extend or to retract tongue 33 from lock mechanism 22. The movement of the tongue 33 is transmitted through various devices to cause simultaneous movements of extension outwardly or retraction inwardly of locking bolts 20 and combination locking bolt 19. Combination lock bolt 19 is connected directly to tongue 33 by a hook means which will be explained in greater detail with respect to FIG. 4. The movement of tongue 33 is transmitted to link bar 23 by means of pin 34 which will be explained in greater detail with respect to FIG. 4. Link bar 23 is therefore made to move simultaneously with movement of tongue 33 and the movement of link bar 23 is transmitted through lever arms 24 to locking bolts 20. Slot 26 in link bar 23 is made to accomodate downwardly depending fingers 24 from the inner ends of link arms 24. Arms 24 pivot around lever arm bolts 41 to cause a corresponding movement in upwardly extending fingers 28 which in turn are connected to recesses 27 in locking bolts 20. It will be appreciated therefore that oscillatory movement of link arm 23 is transmitted through slot 26 to fingers 25 through pivot 41 to fingers 28 causing bolts 20 to move outwardly and inwardly simultaneously. The positions of these components in the unlocked position is shown in dotted lines whereby slot **26*a* and lever arm 24*a* have caused an inward movement of locking bolt 20 to the position show at 20*a***.

An important feature of this invention is a means for causing the entire assembly to remain in a locked position with locking bolts 19 and 20 extended outwardly when combination lock mechanism 22 has been displaced from its normal position. One of the methods used by thieves to break into a safe is to use a sledge hammer against the top of dial 15 to break the combination lock mechanism away from its connection to locking bolts 19 and 20 and thus permit unlocking of the door. In the assembly of this invention there is a mechanism to safeguard against such a procedure. Relocking bar 29 is positioned to pivot around relocking bar screw 42 from the position shown in solid lines to the position **29*a* shown in dotted lines. When relocking bar 29 is in position shown in dotted lines at 29*a*, it mates with notch 32 in link bar 23. In that position link bar 23 is prevented from movement which would retract locking bolts 19 and 20. Relocking bar 29 is held in its normal position by bracket 31 which is attached to combination lock mechanism 22. Relocking bar 29 is biased to move in the direction of 29*a* by spring 30. Relocking bar 29 is not attached to combination lock mechanism 22 and thus if lock mechanism 22 is displaced downwardly, e.g. by a thief hammering on dial 15, bracket 31 is likewise displaced downwardly and will no longer be able to retain relocking bar 29 in its normal position. Once bracket 31 has been moved by an amount equal to the thickness of relocking bar 29, relocking bar 29 will be released and will immediately move to position 29*a* to prevent any movement of link bar 23, which is not connected to combination lock mechanism 22 except through loose fitting pin 34**.

Figure 4:
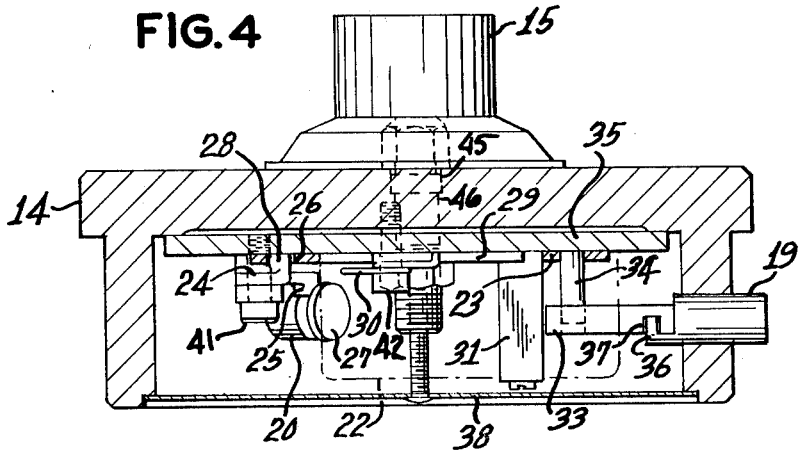
FIG. 4 is a cross sectional view taken along line 4—4 of FIG. 3.

In FIG. 4 there is an elevation view of relocking bar 29 spring 30, bracket 31, and pivot screw 42. This view may be of assistance in understanding the operation of relocking bar 29.

It may also be seen in FIG. 4 that all of the internal mechanism of door 14 is mounted on a hardened steel plate 35 which also serves as a barrier to prevent tampering by means of a drill through the outer wall of door 14. In prior art safes hardened steel plate 35 was welded to the outer wall of door 14 in the same general location as shown in FIG. 4 to serve as a barrier to a drill. It is an improvement of this invention to attach plate 35 to door 14 by means of bolts 17. This improvement eliminates the expense of welding and also eliminates the softening effect that occurs when the hardened plate is subjected to the heat of welding. The special design of bolts 17 makes it tamperproof as is described with respect to FIG. 5.

Tongue 33 is shown in its outwardly extended position causing combination lock bolt 19 to be in an outwardly extended position. Lock bolt 19 is attached to tongue 33 by a hook member 36 on bolt 19 fitting into a transverse slot 37 in tongue 33. Pin 34, which connects tongue 33 with link bar 23, is affixed to tongue 33 by screw thread means or other appropriate means to permanently attach the two members to each other. The upper end of pin 34 fits into an appropriate recess in link bar 23, preferably a hole slightly larger than pin 34 to provide a working tolerance to prevent any binding between link bar 23 and pin 34. It will be appreciated that any movement right or left of tongue 33 is transmitted directly into a similar movement of link bar 23.

There is also shown in FIG. 4 an inside cover plate 38 which is merely used to prevent dirt and dust from interfering with the mechanism of the door assembly. This plate 38 is attached by suitable screws at convenient locations. In this embodiment, plate 38 is attached by two screws mating with tapped holes in bolts 17.

Figure 5:
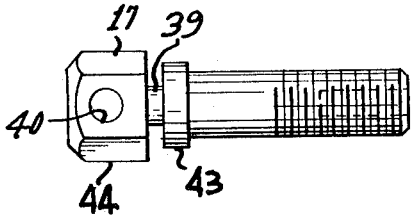
FIG. 5 is an elevational view of a weakened shoulder bolt of this invention.

In FIG. 5 there is shown a shoulder bolt 17 which is employed for attachment of hardened steel plate 35 to door wall 14 as mentioned above, and for the attachment of handle 18 to the door assembly as shown especially in FIG. 1. Bolts 17 extend through corresponding counterbores 45 in bores 46 in door 14 and are attached thereto by lock nuts 21. Each bolt has a recess 40 into which handle 18 may be attached. Since these bolts 17 offer a possible access to the interior mechanism of door 14 they must likewise be made tamperproof. In this instance the thief might attempt to unloosen the bolt and thereby have access to the interior of door 14 through the bore into which bolt 17 was fitted. Bolt 17 is made to be weakened in a shank portion adjacent the head of the bolt sufficiently that when an attempt is made to unloosen bolt 17 from its lock nut 21 the bolt will shear in its weakened shank portion and leave the theif with no easy access to the interior of door 14. Although there may be several methods of weakening bolt 17, a convenient means is simply to machine the shank portion of bolt 17 to a small enough diameter as shown at 39 that the bolt will shear when a wrench applies sufficient torque to the head of the bolt. Shoulder 43 is of sufficient size to fit snugly into counterbore 45 of bore 46 through wall 14. Therefore, if the head 44 is sheared away from bolt 17 at shank portion 39, the remainder of bolt 17 and attached lock nut 21 will be held in place by shoulder 43 in the counterbore 45 of the bore 46 as seen in FIG. 4.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. In a safe door assembly comprising a door casing, a door, a plurality of locking bolts operated by a combination lock so as to be selectively extended outwardly from or retracted inwardly into said door to lock or unlock, respectively, said door to said casing; said casing including a seat to accommodate a shoulder on said door and recess to receive each of said outwardly extended locking bolts; said door also including a combination lock with a retractable tongue operatively connected to a sliding link bar with lever means to simultaneously extend or retract said locking bolts; the improvement comprising a pivotable relocking bar spring biased to pivot into a position whereby a portion of said bar mates with a corresponding portion in said link bar to prevent said link bar from sliding, said relocking bar positioned to mate with said link bar when said combination lock is disposed inwardly from its normal position; a hardened steel barrier separating the mechanism of said combination lock from the outside wall of said door; and a plurality of bolts through the outer wall of said door and through said hardened steel barrier fastened with lock nuts and supporting a handle for moving said door away from said casing, said bolts being weakened in their shank portions to shear off the head of the bolt if subjected to the torque normally required for unloosening said bolt from its lock nut.

2. The assembly of claim 1 which additionally comprises a hardened steel barrier spaced outwardly from said recess.

3. The assembly of claim 1 wherein said door and said casing are circular.

4. The assembly of claim 1 wherein said casing is positioned in the floor of a room and said door rests thereon by gravity.

5. The assembly of claim 1 which comprises at least three locking bolts.

6. The assembly of claim 1 wherein said tongue is directly linked to one of said locking bolts by a hook means and also directly connected to said link bar by a pin means.

7. In a safe door assembly comprising a door casing, a door, a plurality of locking bolts reciprocally movable outwardly to mate with a recess in the door casing, a combination lock operatively connected with said locking bolts to selectively permit or prevent movement of said bolts, respectively, to lock or unlock said door; the improvement comprising a hardened steel barrier spaced apart from and around the outer end of said locking bolts, and a plurality of bolts through the outer wall of said door and through a hardened steel plate interiorly adjacent said outer wall are fastened with lock nuts and support a handle for moving said door away from said casing, said bolts being weakened in their shank portions to cause shearing of the bolt when subjected to the torque normally required for unloosening said bolt from its nut.

8. The assembly of claim 7 wherein said door and door casing are circular in shape and said barrier is a ring.

9. The assembly of claim 7 wherein one of said locking bolts is connected to a retractable tongue of said combination lock by a hook means, and the other locking bolts are connected to said tongue by lever means which cause all of said locking bolts to move simultaneously.

10. The assembly of claim 9 wherein said lever means comprises a slidable link bar having a pin connection to said tonque and pivotable arms connecting said link bar to said other locking bolts.

11. The assembly of claim 10 which additionally comprises a pivotable relocking bar spring biased to pivot into a position where a portion of said bar mates with a corresponding portion of said link bar whereby the link bar is prevented from sliding, said spring bias being positioned to release said relocking bar to mate with said link bar when said combination lock is displaced inwardly from its normal position.

12. In a safe door assembly comprising a door casing, a door, a plurality of locking bolts reciprocally movable outwardly to mate with a recess in said door casing, and a combination lock operatively connected with said locking bolts to selectively cause outward or inward movement of said bolts, respectively, to lock or unlock said door; the improvement which comprises a reciprocable tongue attached to said combination lock said tongue moving linearly outwardly and inwardly, respectively, to lock and to unlock said safe, said tongue having a transverse slot at the outer end thereof to fit with a hook-shaped end of one of said locking bolts; said tongue also having a pin extending laterally therefrom to fit into a corresponding hole in a slidable link bar to which are connected lever means to cause all other locking bolts to move simultaneously with the movement of said locking bolts with the hook-shaped end; and two bolts through the outer wall of said door and through a hardened steel plate interiorly adjacent said outer wall fastened at the inside of said plate with lock nuts and supporting a handle for moving said door away from said casing, said bolts having a head with a weakened shank portion immediately adjacent said head to cause shearing of the bolt when subjected to a torque normally required to unloosen said bolt from said lock nut; said bolts also having adjacent said weakened shank portion a shoulder portion of larger diameter than all other shank portions of said bolt and of appropriate size to fit into a counterbore in said outer wall.

13. The assembly of claim 12 wherein a hardened steel barrier is spaced outwardly from the outer extremities of said locking bolts and positioned to prevent access thereto by a drill.

14. The assembly of claim 12 wherein said door and door casing are circular in shape.

15. The assembly of claim 12 which comprises a pivotable relocking bar spring biased to pivot into a position whereby said relocking bar mates with a corresponding portion of said slidable link bar to prevent it from sliding when said combination lock is displaced inwardly from its normal position.

16. In a safe door assembly comprising a door casing, a door, a plurality of locking bolts reciprocally movable outwardly to mate with a recess in said door casing, and a combination lock operatively connected with said locking bolts to selectively cause outward or inward movement of said bolts, respectively, to lock or unlock said door; the improvement which comprises a handle for moving said door away from said casing, and a plurality of bolt and lock nut combinations passing through a bore in the outer wall of said door and through a hardened steel plate interiorly adjacent said outer wall to support said handle and said hardened steel plate, the head of each bolt being on the outside of said door and the corresponding lock nut being on the inside of said door, each of said bolts being weakened in a shank portion adjacent said head to the extent that application of the normal torque to unloosen said bolt from said lock nut will cause shearing of the bolt at said weakened portion, said bore including a counterbore to accommodate an enlarged shoulder portion on said bolt adjacent said weakened portion.

17. The assembly of claim 16 wherein said weakening is the result of reducing the diameter of said shank portion over a short length of said shank portion.

18. The assembly of claim 16 wherein a hardened steel barrier is spaced outwardly form the outer extremities of said locking bolts and positioned to prevent access thereto by a drill.

19. The assembly of claim 16 wherein said door and door casing are circular.

20. The assembly of claim 16 comprising two of said bolt end lock nut combinations.

21. The assembly of claim 16 wherein said combination lock included a reciprocable tongue capable of linear movement outwardly or inwardly, respectibely to lock or unlock said door, said tongue being connected by a hook attachment to a first locking bolt and being connected by a pin attachment to a slidable link bar which in turn is connected by lever means to the other locking bolts so as to move outwardly and inwardly with said first locking bolt.

22. The assembly of claim 21 comprising a pivotable relocking bar spring biased to pivot into a position where a portion of said bar mates with a corresponding portion of said slidable link bar whereby said link bar is prevented from sliding, said spring bias being positioned to release said relocking bar to mate with said link bar when said combination lock is displaced inwardly from its normal position.

23. The assembly of claim 7 which comprises at least three locking bolts.

24. The assembly of claim 12 which comprises at least three locking bolts.

25. The assembly of claim 13 wherein said barrier is a ring.

* * * * *